United States Patent [19]

Lombardo

[11] Patent Number: 4,506,927

[45] Date of Patent: Mar. 26, 1985

[54] CONVERTIBLE TABLE, CHAIR, AND BED COMBINATION

[76] Inventor: Anthony Lombardo, 979 Third Ave., New York, N.Y. 10022

[21] Appl. No.: 453,699

[22] Filed: Dec. 27, 1982

[51] Int. Cl.[3] ..... A47C 13/00

[52] U.S. Cl. ..... 297/118; 5/3; 297/119

[58] Field of Search ..... 297/119, 118, 120, 124, 297/125, 126, 127, 163; 5/3

[56] References Cited

U.S. PATENT DOCUMENTS 389,911 9/1888 Tribbey ..... 297/118 X
1,113,960 10/1914 Davidson ..... 297/120 X

FOREIGN PATENT DOCUMENTS 142160 7/1951 Australia ..... 297/119
161033 4/1921 United Kingdom ..... 297/119

*Primary Examiner*—James T. McCall
*Attorney, Agent, or Firm*—Richard L. Miller

[57] ABSTRACT

A convertible table, chair and bed combination is provided and consists of a first flat frame member having four legs, a second flat frame member and a third flat frame member having four legs. The second flat frame member is pivotally connected to top of one side of the first flat frame member and the bottom of one side of the third flat frame member so that by placing the third flat frame member in different positions a coffee table, a chair or a bed can be formed. A mattress is used in conjunction with the chair and the bed. A platform having a pair of pivotable legs is pivotally connected to the third flat frame member so that a coffee table can be formed.

2 Claims, 10 Drawing Figures

CONVERTIBLE TABLE, CHAIR, AND BED COMBINATION

BACKGROUND OF THE INVENTION

The present invention relates generally to tables, chairs and beds and more specifically it relates to a convertible table, chair and bed combination.

If a person lives in a house or an apartment with limited room space it becomes quite difficult to fill that room space with the proper furniture one needs for comfort. This situation is not desirable so accordingly it is in need of an improvement.

SUMMARY OF THE INVENTION

A principle object of the present invention is to provide a convertible table, chair and bed combination that will fold up to a coffee table for limited space.

Another object is to provide a convertible table, chair and bed combination that will utilize a mattress when it is in the form of a chair or bed.

An additional object is to provide a convertible table, chair and bed combination that can form a dining table when it is opened to form a chair.

A further is to provide a convertible table, chair and bed combination that is simple and easy to use.

A still further object is to provide a convertible table, chair and bed combination that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
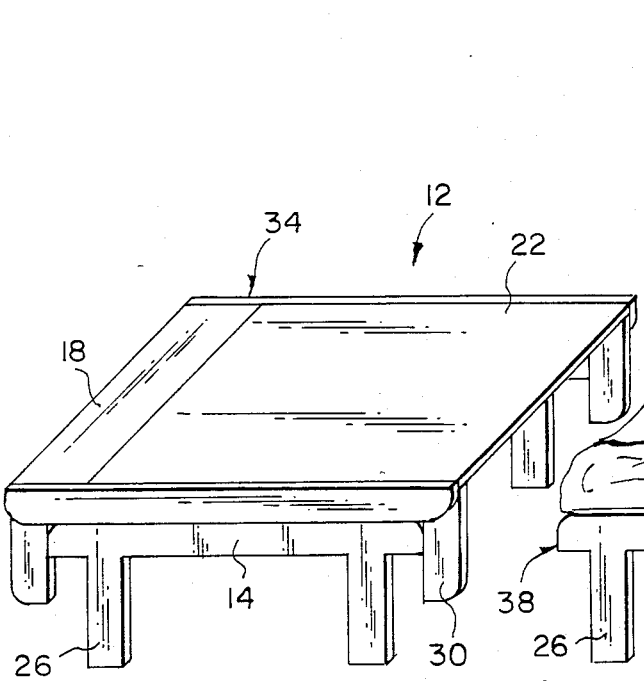
FIG. 1 is a perspective view of the present invention as a coffee table.
Figure 2:
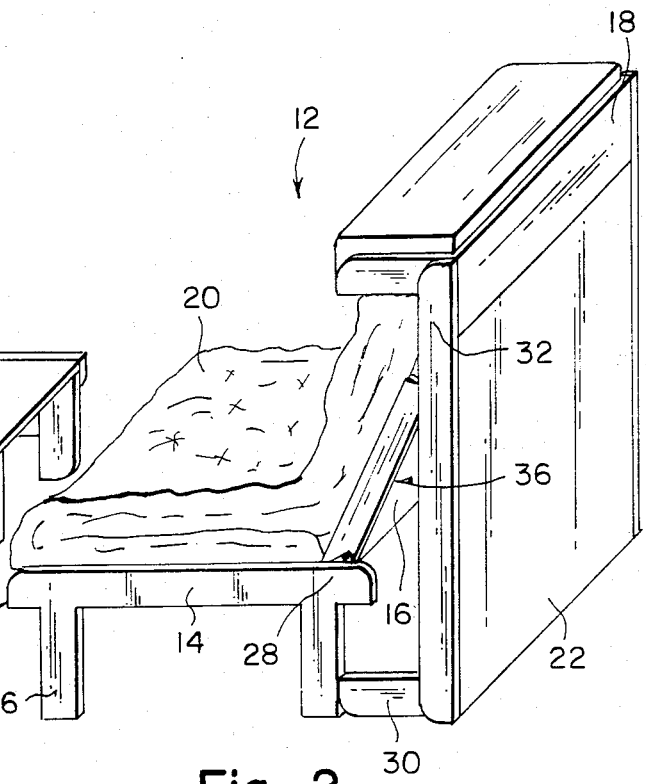
FIG. 2 is a perspective view of the invention as a chair.

Turning now descriptively to the drawings, in which similar reference characters denote similar elements throughout the several views, FIGS. 1 through 10 illustrate a convertible table, chair and bed combination 12 that basically consists of a first flat frame member 14, a second flat frame member 16, a third flat frame member 18, a mattress 20, a platform 22 and a pair of long legs 24.

The first flat frame member 14 has four legs 26. Each leg 26 is near a corner of the first flat frame member 14 to engage a floor (not shown).

The second flat frame member 16 is pivotally connected (at 28) to top of one side of the first flat frame member 14.

Figure 4:
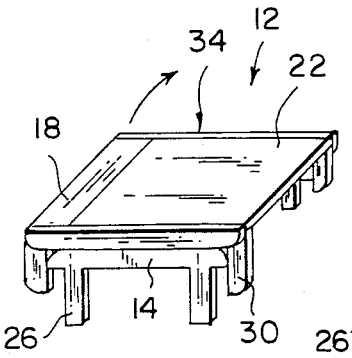
FIGS. 4, 5 and 6 are perspective views showing how the invention is turned from a coffee table into a chair.
Figure 5:
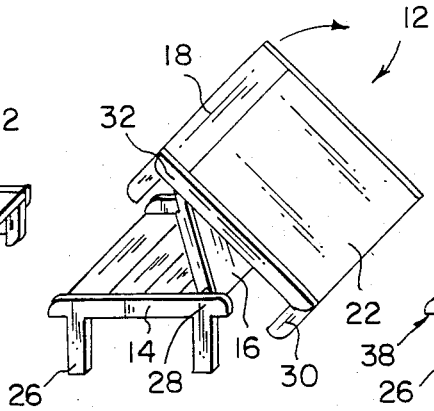
Figure 6:
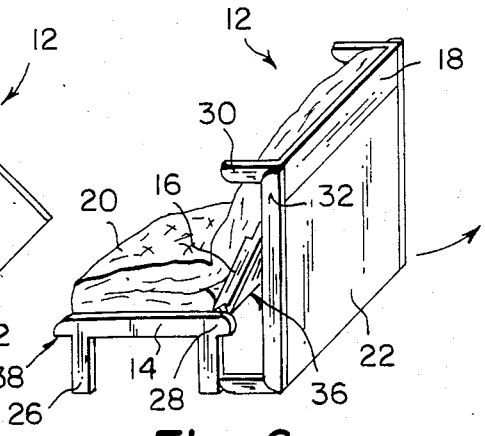
Figure 7:
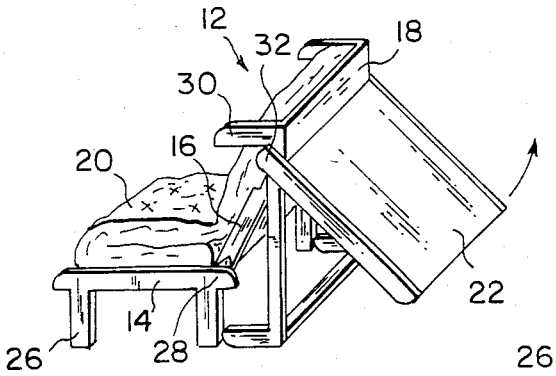
FIGS. 7 and 8 are perspective views showing how the invention is turned form a chair into a chair having a dining table.

The third flat frame member 18 has four legs 30. Each leg 30 is at a corner of the third flat frame member 18. The third flat frame member 18 is pivotally connected (at 32) to one side from bottom to the second flat frame member 16, when the second flat frame member 16 is down over the first flat frame member 14, the thrid flat frame member 18 will fit over the first flat frame member 16 to form a coffee table 34 as shown in FIGS. 1 and 4.

When the third flat frame member 18 is placed in a vertical position engaging the floor the second flat frame member 16 will pivot to an inclined position to form a back rest 36. The mattress 20 can be folded over onto the first flat frame member 14 and against the second flat frame member 16 to form a chair 38 as best show in FIGS. 2 and 6.

Figure 3:
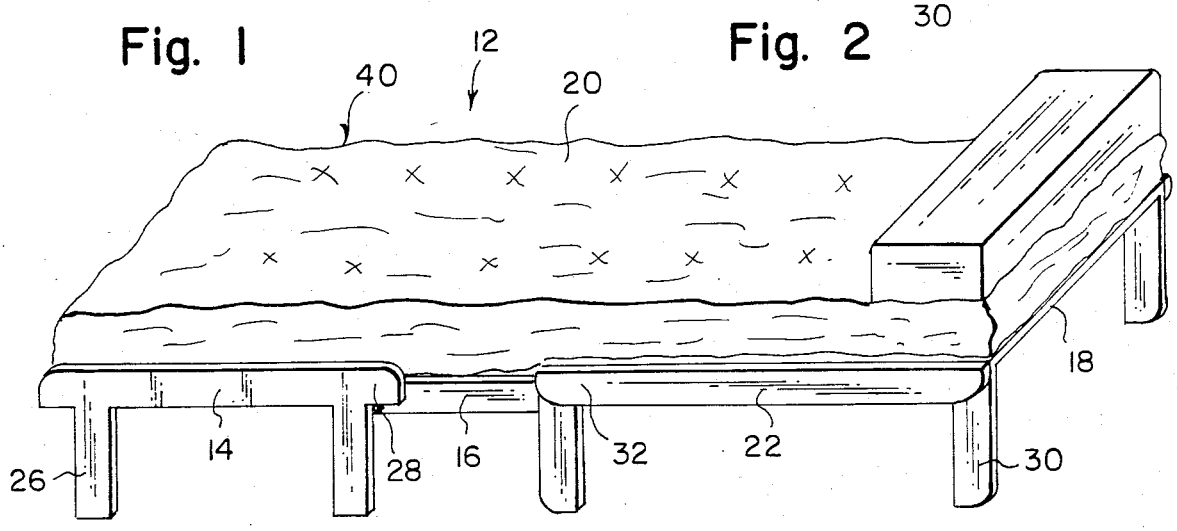
FIG. 3 is a perspective view of the invention as a bed.
Figure 10:
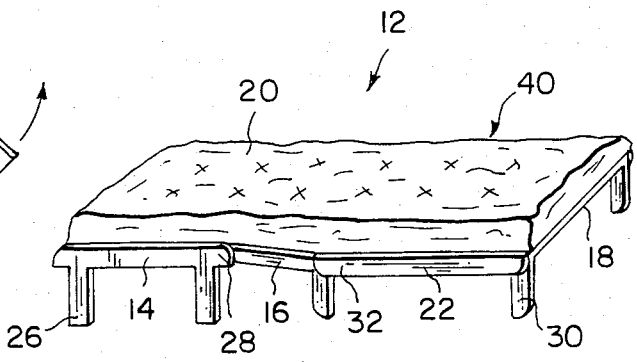

When the third flat frame member 18 is placed in a horizontal position with the legs 30 engaging the floor the second flat frame member 16 will pivot to a horizontal position. The mattress 20 can be placed onto the first flat frame member 14, the second flat frame member 16 and the third flat frame member 18 to form a bed 40 as shown in FIGS. 3 and 10.

The platform 22 is pivotally connected to the third flat frame member 18 (at 32), which is the same side the third flat frame member 18, that is pivotally connected to the second flat frame member 16 as previously described. When the third flat frame member 18 is placed in a vertical position the platform 22 can pivot to a horizontal position.

Figure 8:
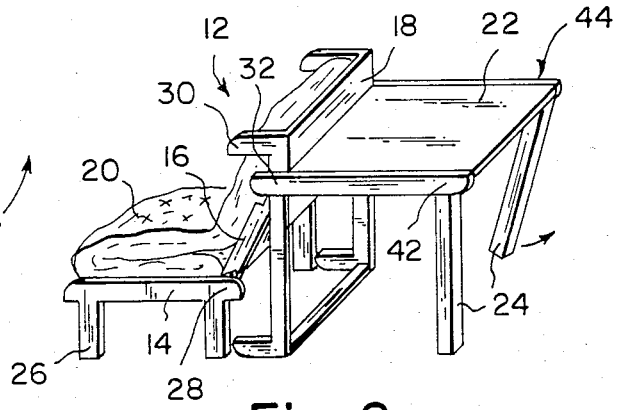
Figure 9:
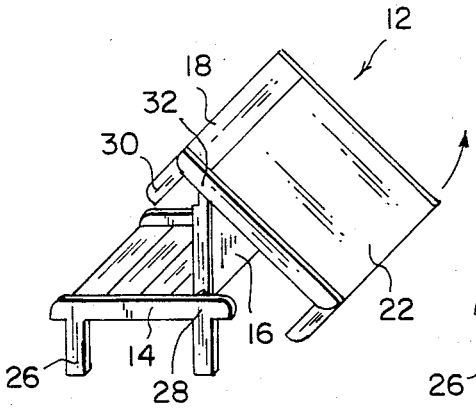
FIGS. 9 and 10 are perspective view showing how the invention is turned form a chair into a bed.

Each of two long legs 24 are pivotally connected (at 42) to underside near a corner at other side of the platform 22. When the platform 22 is in a horizontal position the legs 24 will pivot to a vertical position engaging the floor to form a dining table 44 as shown in FIG. 8.

Thus it will be observed that in operative use one single piece of furniture can be transformed to serve as a bed, a chair, a low coffee table, a combination chair and dinning table, or a combination low coffee table and dinning table, as respectively best illustrated in FIGS. 3, 2, 1, 8, and 8 with mattress removed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A convertible table, chair and bed combination comprising:

(a) a first flat frame member having a plurality of legs, each said leg near a corner of said first flat frame member to engage a floor;

(b) a second flat frame member pivotally connected to the top of one side of said first flat frame member;

(c) a third flat frame member also having a plurality of legs, each said leg near a corner of said thrid flat frame member, said third flat frame member pivotally connected at one side from bottom to said second flat frame member so that when said second flat frame member is down over said first flat frame member, said third flat frame member will fit over said first flat frame member and second flat frame member so as to form a coffee table;

(d) a platform pivotally connected to said third flat frame member at the same side said third flat frame member is pivotally connected to said second flat frame member so that when said third flat frame member is placed in a vertical position said platform can pivot to a horizontal position; and (e) at least one long leg pivotally connected to an underside of said platform so that when said platform is in a horizontal position said long leg will pivot to a vertical position engaging said floor to form a dining table.

2. A convertible table, chair and bed combination as recited in claim 1 that further comprises a mattress so that when said third flat frame member is placed in a vertical position engaging said floor, said second flat frame member will pivot to an inclined position to form a back rest whereby said mattress can be folded over onto said first flat frame member and against said second flat frame member to form a chair and when said third flat frame member is placed in a horizontal position with said legs engaging said floor said second flat frame member will pivot to a horizontal position so that said mattress can be placed onto said first flat frame member, said second flat frame member and said third flat frame member to form a bed.

* * * * *